US005275321A

United States Patent [19]

Manu et al.

[11] Patent Number: 5,275,321

[45] Date of Patent: Jan. 4, 1994

[54] PLASTIC FILM FOOD WRAP DISPENSER

[75] Inventors: Alexander Manu; Harry Mahler, both of Toronto, Canada

[73] Assignee: The Axis Group Inc., Toronto, Canada

[21] Appl. No.: 935,119

[22] Filed: Aug. 27, 1992

[51] Int. Cl.[5] ..... B26F 3/02; B65D 85/67

[52] U.S. Cl. ..... 225/45; 225/77; 225/90; 206/407; 242/55.053

[58] Field of Search ..... 225/25, 39, 42, 44, 225/45, 56, 77, 90; 242/55.53; 206/407, 389

[56] References Cited

U.S. PATENT DOCUMENTS

| | | | |
|---|---|---|---|
| 987,952 | 3/1911 | Brown | 225/42 X |
| 1,676,854 | 7/1928 | Casterline | 225/44 |
| 3,291,299 | 12/1966 | Minnotte, Jr. | 206/407 X |
| 3,549,066 | 12/1970 | Wankow | 225/25 |
| 3,893,609 | 7/1975 | Jamois et al. | 225/42 |
| 3,974,947 | 8/1976 | Budny | 225/25 |
| 4,307,828 | 12/1981 | Sias et al. | 225/25 |
| 4,534,497 | 8/1985 | Neale | 225/25 |
| 4,666,072 | 5/1987 | McCarter | 225/25 |
| 4,898,312 | 2/1990 | Hwang | 225/77 X |
| 4,936,452 | 6/1990 | Pauley | 242/55.53 X |
| 5,046,677 | 9/1991 | Loewe et al. | 242/55.53 X |
| 5,050,788 | 9/1991 | Taguchi et al. | 225/25 |

*Primary Examiner*—Hien H. Phan
*Assistant Examiner*—Clark F. Dexter
*Attorney, Agent, or Firm*—Nixon & Vanderhye

[57] ABSTRACT

A dispenser for rolled sheet material includes a container having at least one open end and a cap to close the open end. A slot is disposed along the length of the container parallel to its longitudinal axis with a flange extending from the slot and a cutting edge along the outer most edge of the flange. A thumb print size frictional surface is centrally located on the upper surface to permit the user to press the sheet material onto the upper surface to secure it during cutting on the cutting edge. A number of grooves may be disposed along the length of the flange parallel to the slot.

4 Claims, 3 Drawing Sheets

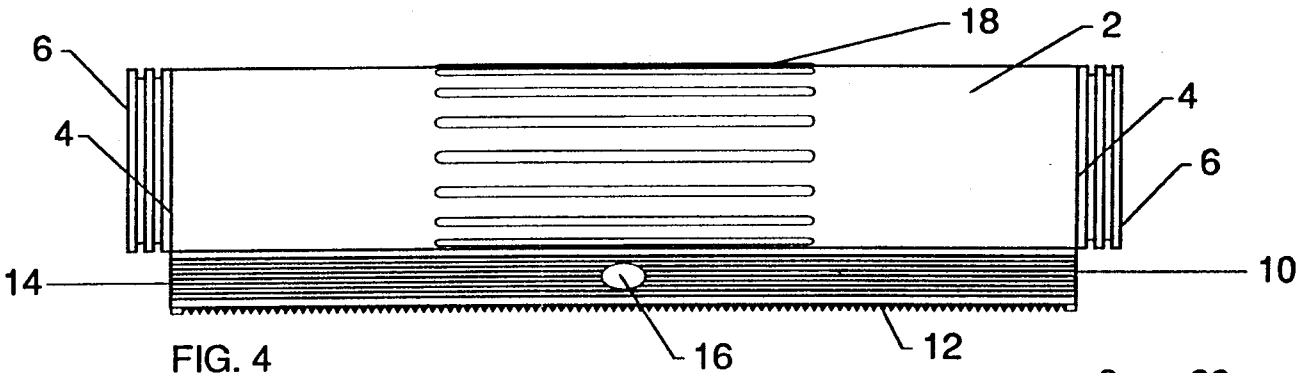
FIG. 4
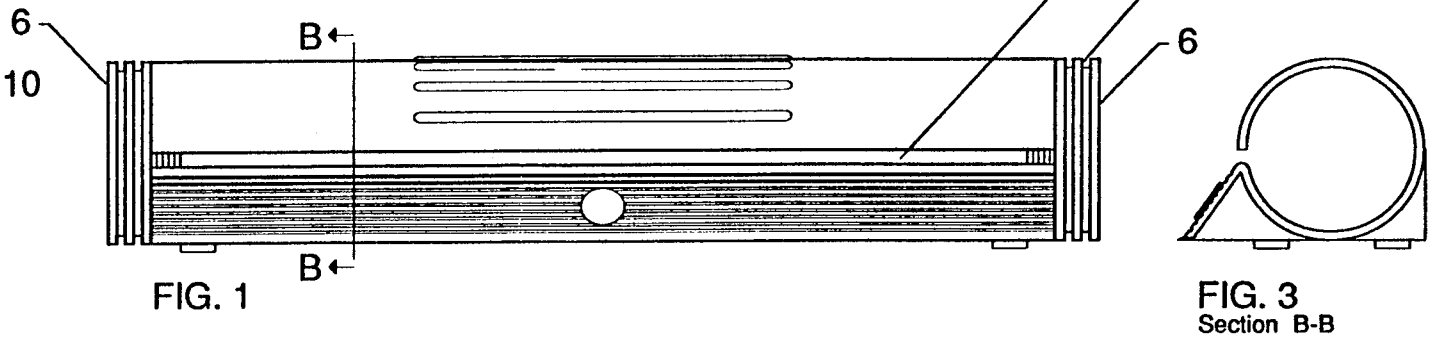
FIG. 1
FIG. 3
Section B-B
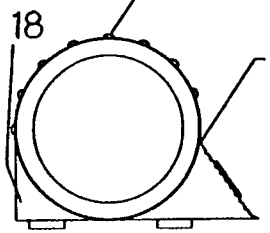
FIG. 2
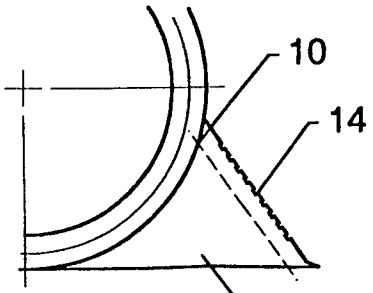
FIG. 5

Sec A-A

PLASTIC FILM FOOD WRAP DISPENSER

TECHNICAL FIELD

The present invention relates to the field of dispensers for rolled sheet material, particularly plastic film sheeting, for example, a dispenser for food wrap plastic film.

BACKGROUND ART

Environmental concerns about the disposal of waste products has led to redesign of many products with a view to reducing unnecessary packaging. Rolled sheet material, particularly that intended for use in the food industry or the home, is often packaged in a cardboard container with a flip top lid and a cutting edge. A user opens the lid, pulls out the desired length of sheet material from the roll within and tears it off against the cutting edge. The package is convenient for a user since it may be picked up and used in any location and then tossed onto a counter or stored in a drawer or the like. The package is inconvenient from an environmental point of view because it must be disposed of after the roll is exhausted and the cutting edge, if made of a metal strip, interferes with recycling of the paper package.

There are many designs of reusable dispensers for rolled sheet material which respond to these environmental concerns. Some employ cases which are similar in shape and design to the cardboard packaging that they are intended to replace but are fabricated of plastic or other suitable material. Many, if not all, of these cases are intended to be wall mounted. The known cases are fabricated from a plurality of parts and often have hinges or other moving elements.

In its elegance, simplicity and novel functional features, the present invention particularly directed to be used as a hand held dispenser rather than wall mounted unit thereby providing the advantage of the paper packaging in that the user may acquire, use and store it in any convenient location. While the combination of novel features of the present invention is primarily adapted to facilitate portability and hand held use, nevertheless, it will be appreciated from the following disclosure that the invention may be adapted for wall mounting if desired.

DISCLOSURE OF THE INVENTION

The present invention is a dispenser for a rolled sheet material comprising a container having at least one open end, at least one cap to close said open end(s), a slot along the length of said container parallel to the longitudinal axis of said container, a flange extending from said slot and a cutting edge along the outermost edge of said flange. The container is sized to fit standard rolls of sheet material and has an outside diameter that fits within the average person's hand in a manner where the person's thumb may be pressed onto the flange.

The container and flange may be formed integrally of one material, for example by injection moulding a plastic element. Similarly, the cutting edge may be formed in the same process of the same material. In other embodiments the cutting edge may be separately fabricated and attached to the flange. The caps are removable from the open end(s) of the dispenser to permit the rolled sheet material to be loaded into the dispenser. Once loaded the sheet may be started through the slot and the cap(s) replaced to close the ends to secure the rolled material within the container during use. In a preferred embodiment both ends of the container are open and two caps are used to close them. It is also preferred that the container will have a cylindrical shape or will be otherwise moulded to fit in the palm of the hand of a user.

The container and flange are made of material that will permit the rolled sheet material to be easily drawn out during dispensing. The flange may be fitted, however, with a friction means along part of its dispensing surface, for example, a strip(s) or dot(s) to permit the user to grip the sheet firmly with a thumb during tearing off against the cutting edge. The outer surface of the container may also be fitted with a frictional surface means, for example, longitudinal frictional strips, to facilitate gripping with one hand. In a preferred embodiment discussed later in more detail, the flange is fitted with longitudinal grooves which are intended to hold the sheeting material releasably against the flange during and after cutting. The sheeting material, usually a thin film of plastic, will adhere to the flange over and into the grooves. As the film is lifted air must be drawn into the grooves to release the film from the flange. It is understood that the grooves affect the extent to which the film adheres to the flange. Further, the grooves provide a convenient surface for picking up an edge of the film.

The flange extends from the container for a short distance sufficient to provide a pressing surface for a thumb of the user and sufficient to provide an adhesion surface for a protruding end of the sheeting material to cling to when not in use. The flange may cooperate with the container or the caps to provide a means to rest the device on a flat surface. The cutting edge may extend in line with the flange or at an angle thereto as desired for cutting.

A preferred embodiment of the invention is described hereafter as shown in the appended drawings.

BRIEF DESCRIPTION OF THE DRAWINGS

In the drawings which illustrate a preferred embodiment of this invention:

FIG. 1 is a front view of this embodiment of the invention;

FIG. 2 is a side view of this embodiment;

FIG. 3 is a sectional view of the invention taken generally along the line B—B of FIG. 1;

FIG. 4 is a top view of the invention;

FIG. 5 is an enlarged-scale view of the lower right portion of FIG. 2;

DESCRIPTION OF THE PREFERRED EMBODIMENT

Figure 6:
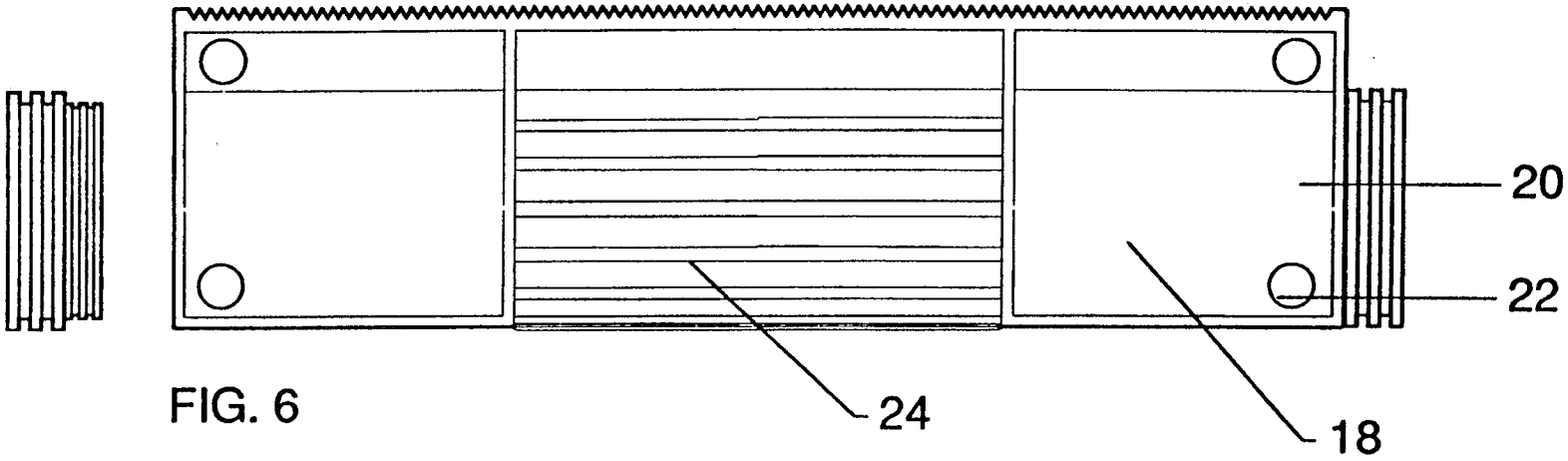
FIG. 6 is a bottom view of the invention.

In the description of the preferred embodiment, similar numbers indicate similar elements.

Referring to FIGS. 1 and 2, the preferred embodiment is a dispenser comprised of a cylinder 2 having two open ends 4, two caps 6 closing the said open ends 4, a slot 8 disposed along the length of cylinder 2 parallel to the longitudinal axis of the said cylinder 2, a flange 10 extending from slot 8 and a cutting edge 12 disposed along the outermost edge of the flange 10. In this embodiment, cylinder 2, flange 10 and cutting edge 12 are formed integrally of plastic material.

Flange 10 extends from slot 8 a short distance sufficient to provide a pressing surface for a thumb of the user and an adhesion surface for a protruding end of the sheeting material to cling to when not in use. In this embodiment, flange 10 is fitted with a friction means, namely, a plurality of grooves 14 disposed along the length of the flange 10 parallel to slot 8, and a dot 16. Grooves 14 provide a frictional or adhering surface means to hold the sheeting material both during and after cutting. Dot 16 permits the user to grip firmly the sheeting material against flange 10 with a thumb during cutting. Cutting edge 12 extends upwardly from the line of the flange In this embodiment, flange 10 cooperates with cylinder 2 to form a base 18. Base 18 provides a means to rest the dispenser on a flat surface. As shown in FIG. 6, base 18 is fitted with a grooves 20 disposed along the width of base 18 perpendicular to the longitudinal axis of cylinder 2. Grooves 20 receive feet 22. Feet 22 provide a further means to rest the dispenser on a flat surface and may be made of any suitable material, such as rubber.

Figure 7:
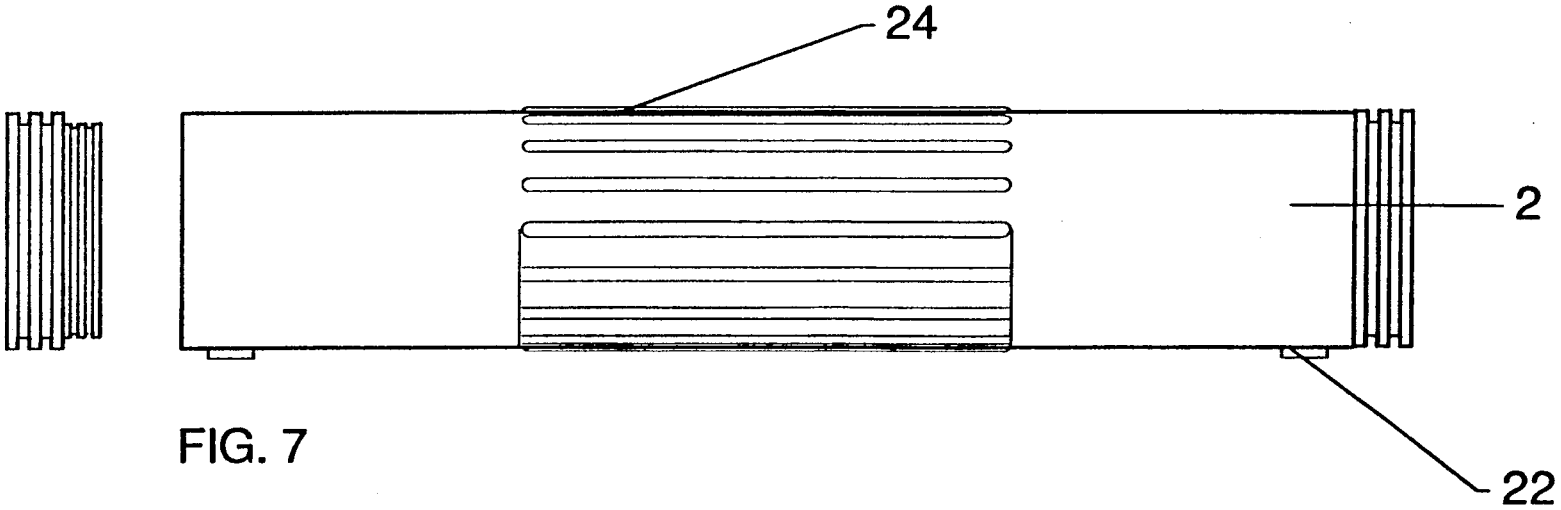
FIG. 7 is a rear view of the invention.
Figure 11:
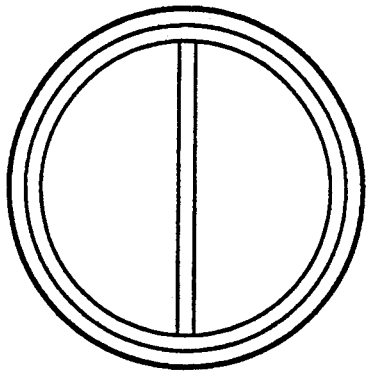
FIG. 11 is an internal view of the cap.

The outer surface of cylinder 2 is fitted with a plurality of ridges 24 to facilitate gripping of the dispenser with one hand. Ridges 24 are disposed along the outer surface of cylinder 2 parallel to the longitudinal axis of cylinder 2 as illustrated in FIGS. 4, 6 and 7. As shown in FIG. 2, the ridges 24 are raised.

Figure 9:
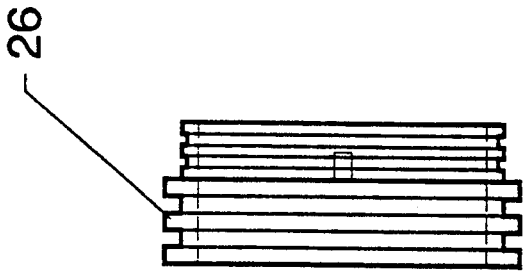
FIG. 9 is the side view of a cap.
Figure 8:
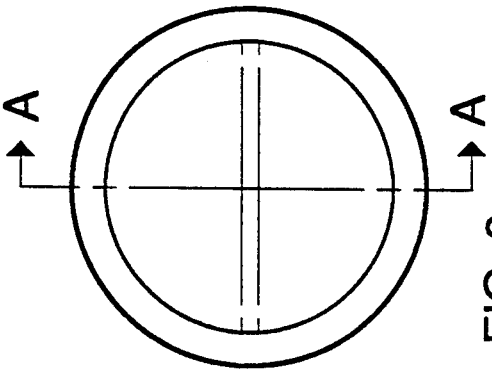
FIG. 8 is the end view of a cap.
Figure 10:
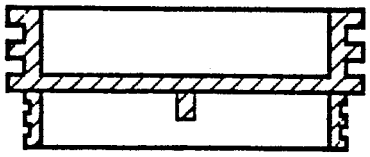
FIG. 10 is sectional view of the cap taken generally along the line A—A of FIG. 8.

In this embodiment, caps 6 are configured and sized to receive cylinder 2 and thereby close the open ends 4. As illustrated in FIG. 9, caps 6 are comprised of a multiplicity of ridges 26 to facilitate the gripping of the caps 6 and their removal.

Various modifications and changes may be made in the specific illustrated structure without departing from the spirit and scope of the present invention as is defined in the appended claims.

The embodiments in which an exclusive property and privilege are claimed are:

1. A dispenser comprising a cylindrical container having two open ends and a length, two caps, each cap removably attached to one of said open ends for closing said open ends, a slot along the length of said container parallel to a longitudinal axis of said container, a flange extending from said slot to an outermost edge remote from said slot, said outermost edge including a cutting edge, said flange having an upper surface to receive dispensed sheet material, a thumb print sized frictional surface centrally located on said upper surface to permit a user to press the sheet material onto the upper surface to secure the sheet material during cutting a plurality of grooves disposed in said upper surface along the length of the flange parallel to the slot and said outermost edge extending at an angle from the upper surface of said flange and ending in said cutting edge.

2. A dispenser as recited in claim 1 wherein said flange further comprises means for supporting said dispenser when placed on a surface.

3. The dispenser of claim 2 in which the container is cylindrical in shape and sized to fit in the palm of a hand of a user and has frictional means or an outer surface of the container to permit the user to grip the container securely in one hand.

4. The dispenser of claim 1 in which the container is cylindrical in shape and sized to fit in the palm of a hand of a user and has frictional means on an outer surface of the container to permit the user to grip the container securely in one hand.

* * * * *